US008613715B2

(12) United States Patent
Wright et al.

(10) Patent No.: US 8,613,715 B2
(45) Date of Patent: Dec. 24, 2013

(54) PASSIVE MOBILITY EXERCISE AND RANGE-OF-MOTION BED APPARATUS

(75) Inventors: David Wright, Sherill, NY (US); Paul Lindsay, Vernon, NY (US); Robert Metzger, Vernon, NY (US); Ramona Wright, Sherrill, NY (US); Deborah Metzger, Vernon, NY (US)

(73) Assignee: Wright Wellness Solutions, Inc., Sherrill, NY (US)

( * ) Notice: Subject to any disclaimer, the term of this patent is extended or adjusted under 35 U.S.C. 154(b) by 6 days.

(21) Appl. No.: 13/410,878

(22) Filed: Mar. 2, 2012

(65) Prior Publication Data

US 2012/0226202 A1 Sep. 6, 2012

Related U.S. Application Data

(60) Provisional application No. 61/448,233, filed on Mar. 2, 2011.

(51) Int. Cl.
*A61H 1/02* (2006.01)

(52) U.S. Cl.
USPC ..... 601/5; 601/23; 601/33

(58) Field of Classification Search
USPC ..... 601/23, 24, 26, 27, 29, 31, 33, 34, 35, 601/5; 602/32–36, 38, 40; 482/92, 93, 101, 482/102, 131, 907; 5/85.1, 83.1, 81.1 R, 414
See application file for complete search history.

(56) References Cited

U.S. PATENT DOCUMENTS

| | | | | | |
|---|---|---|---|---|---|
| 319,283 | A | * | 6/1885 | Marsh | 5/85.1 |
| 669,217 | A | * | 3/1901 | Hanson | 5/83.1 |
| 1,452,733 | A | * | 4/1923 | Garlock | 602/34 |
| 1,709,153 | A | * | 4/1929 | Pownall | 5/83.1 |
| 1,837,872 | A | * | 12/1931 | Johnson | 602/34 |
| 1,977,944 | A | * | 10/1934 | Haskett | 5/84.1 |
| 2,631,582 | A | * | 3/1953 | Bensfield | 601/33 |
| 2,907,324 | A | * | 10/1959 | Catanzaro | 606/242 |
| 2,921,790 | A | * | 1/1960 | Nawara | 482/133 |
| 3,403,675 | A | * | 10/1968 | Carr | 602/32 |
| 3,699,953 | A | * | 10/1972 | Mason | 602/34 |
| 4,003,479 | A | * | 1/1977 | Reyer | 414/471 |
| 4,202,062 | A | * | 5/1980 | Marcyan | 5/620 |
| 4,409,695 | A | * | 10/1983 | Johnston et al. | 5/601 |
| 4,446,587 | A | * | 5/1984 | Jump | 5/83.1 |
| 4,489,713 | A | * | 12/1984 | Latenser | 606/242 |
| 4,627,119 | A | * | 12/1986 | Hachey et al. | 5/85.1 |
| 4,671,257 | A | * | 6/1987 | Kaiser et al. | 601/34 |
| 4,715,361 | A | * | 12/1987 | Mauldin et al. | 601/101 |
| 5,290,219 | A | * | 3/1994 | Hetrick | 602/32 |
| 5,456,655 | A | * | 10/1995 | Morris | 601/23 |
| 5,501,656 | A | * | 3/1996 | Homma et al. | 601/33 |

(Continued)

*Primary Examiner* — Quang D Thanh
(74) *Attorney, Agent, or Firm* — Bernhard P. Molldrem, Jr.

(57) ABSTRACT

A passive exercise therapy station moves a patient's limb or body part through a prescribed range of motion without stress to the patient's limb or associated joints. A frame is formed of a pair of arches joined in parallel to one another, with a pair of overhead horizontal rails. One or more main cables extend over guide pulleys on the frame and past an adjustable guide carriage that travels along the overhead rails. An actuator positions the guide carriage at a desired location on the overhead rails. An exercise cable descends from the guide carriage to the patient. The exercise cable may be a web attached to the main cable. The exercise therapy station may be wheeled between rooms for therapy of a given patient.

20 Claims, 7 Drawing Sheets

(56) References Cited

U.S. PATENT DOCUMENTS

| | | | | | |
|---|---|---|---|---|---|
| 5,539,941 | A * | 7/1996 | Fuller | 5/85.1 |
| 5,544,371 | A * | 8/1996 | Fuller | 5/85.1 |
| 5,830,162 | A | 11/1998 | Giovannetti | |
| 5,996,150 | A * | 12/1999 | Blevins et al. | 5/613 |
| 6,006,376 | A * | 12/1999 | Williamson | 5/81.1 R |
| 6,592,502 | B1 | 7/2003 | Phillips | |
| 6,685,605 | B1 | 2/2004 | Klossner | |
| 7,062,804 | B2 * | 6/2006 | Rouse et al. | 5/83.1 |
| 7,462,138 | B2 | 12/2008 | Shetty et al. | |
| 7,850,578 | B2 * | 12/2010 | Balaker et al. | 482/70 |
| 2009/0209895 | A1 * | 8/2009 | Tornatore et al. | 602/34 |
| 2009/0259253 | A1 * | 10/2009 | Bensoussan | 606/242 |

* cited by examiner

PASSIVE MOBILITY EXERCISE AND RANGE-OF-MOTION BED APPARATUS

Priority is claimed, under 35 U.S.C. §119(e) of Provisional Application Ser. No. 61/448,233, Mar. 2, 2011.

BACKGROUND OF THE INVENTION

The present invention concerns improvements to passive exercise therapy devices for patients, which can move a limb (or limbs) or body part of a patient through a prescribed range of motion without stress to the patient's limb or associated joints. This invention is an improvement to the type of passive therapy exercise apparatus that is disclosed in Klossner U.S. Pat. No. 6,685,605.

In this type of apparatus a patient is positioned on a bed or similar resting place, and reciprocating cable or cables are attached to a harness or brace worn on the patient's arm, leg, wrist, knee, etc., to lift and lower that body part. The apparatus is worked so as to produce a controlled, rhythmic, repetitive relative motion of the cable in respect to the bed so that the patient's limb is moved through the prescribed range of motion.

The device or apparatus that is described in the aforesaid U.S. Pat. No. 6,685,605 is, unfortunately, quite cumbersome and has several drawbacks. That apparatus requires lifting the patient up to a bed that is elevated at a significant height above the floor of the room. Also, the apparatus requires rocking the bed and patient back and forth while holding the cable(s) fixed on the apparatus frame. This rocking motion can cause discomfort and nausea in some patients.

SUMMARY OF THE INVENTION

Accordingly, it is desired to provide a simpler design to the apparatus, in which the patient is situated at a normal bed height, and in which the patient's bed and the patient remain steady and stationary during the exercise therapy.

It is another object to provide a passive exercise therapy arrangement that avoids the drawbacks of the prior art.

It is another object to provide a passive exercise therapy arrangement that can be transported from room to room in an exercise therapy clinic for the convenience of the patient and staff.

It is yet another object to provide a passive exercise therapy arrangement that can be wheeled in over an existing patient bed, so that the patient does not have to be moved from his or her bed to a separate therapy station in a separate room In accordance with the foregoing objects, a passive exercise therapy apparatus has a frame formed of a pair of arches that are joined in parallel to one another, and having a set of overhead rail members, with a patient bed position defined within the frame, where a patient is placed for passive exercise. One or more cables extend over guide pulley members on the frame and pass across the overhead rail members above the patient bed position. There is a drive system positioned on the frame, either above the patient bed or below it, with the drive system being comprised of a gear motor and a drive wheel, with the one or more cable passing over the drive wheel and/or being reeved to it so that the cable is moved by the drive wheel. There are also one or more adjustably positionable cable carriages on the overhead rail members of the frame. The main cable(s) pass over this, and an exercise cable, or an attached flexible web, descends from it and attach to a limb of the patient. This allows the patient's limb to be moved through a prescribed exercise motion for a given period of time.

Favorably, the drive wheel is oriented horizontally, but alternatively it can be disposed on a horizontal axis. In one embodiment the bed or patient table is positioned within the frame as a part of the apparatus, but in another possible embodiment the apparatus has an open frame and can be wheeled into place over the patient's bed. The cable carriage (s) can have wheels or rollers to roll along the top and/or sides of the upper rails, and a linear actuator can be employed to move the cable carriage to the proper position for a given patient. The cable carriages can include a roller or guide wheel for the cable (or webbing), together with cable tensioners supported on a tensioning arm to hold the cable or webbing in place.

In the most basic terms, the passive exercise apparatus of this invention is comprised of a frame, an adjustable cable rail on the frame, drive motor, a cable drive wheel, and a shield or guard over the moving drive wheel. The cable carriages have associated actuators for adjusting their positions, located on the upper part of the frame. The patient bed frame may be articulated allowing the patient's posture to be adjusted as need be for a given exercise therapy.

The patient bed is favorably positioned at the lower part of the frame. A support bed frame is affixed at its ends to vertical members of the two arches. A headboard, footboard, and left and right side rails are provided for patient safety. Actuators below the bed frame adjust head position and foot position of the patient bed.

A cable runs from beneath the bed frame and over a series of guide pulleys mounted on the frame, so that the cable runs along the top of the frame between the top rails of the arches.

There are guide pulley carriage assemblies positioned between the two arches and their positions can be adjusted using one or more actuators. A rod of the respective actuator is attached to the associated carriage. Favorably, two cable pulley carriages may be employed, one positioned approximately over the headboard, and one over the footboard. The overhead actuators allow control of the overhead positions of these carriages.

The carriages allow the exercise cables to descend to the patient position, and exercise cables, e.g., lengths of a flexible webbing, are coupled with the main cable(s). The exercise cables are then fastened to harnesses or braces on the patient's body part that is to be moved through the prescribed range of motion, and the cables are reciprocated to move the limb gently over the prescribed range of motion.

The main principles invention may be explained with reference to preferred embodiments, as illustrated in the accompanying Drawing figures.

DETAILED DESCRIPTION OF THE PREFERRED EMBODIMENTS

Figure 1:
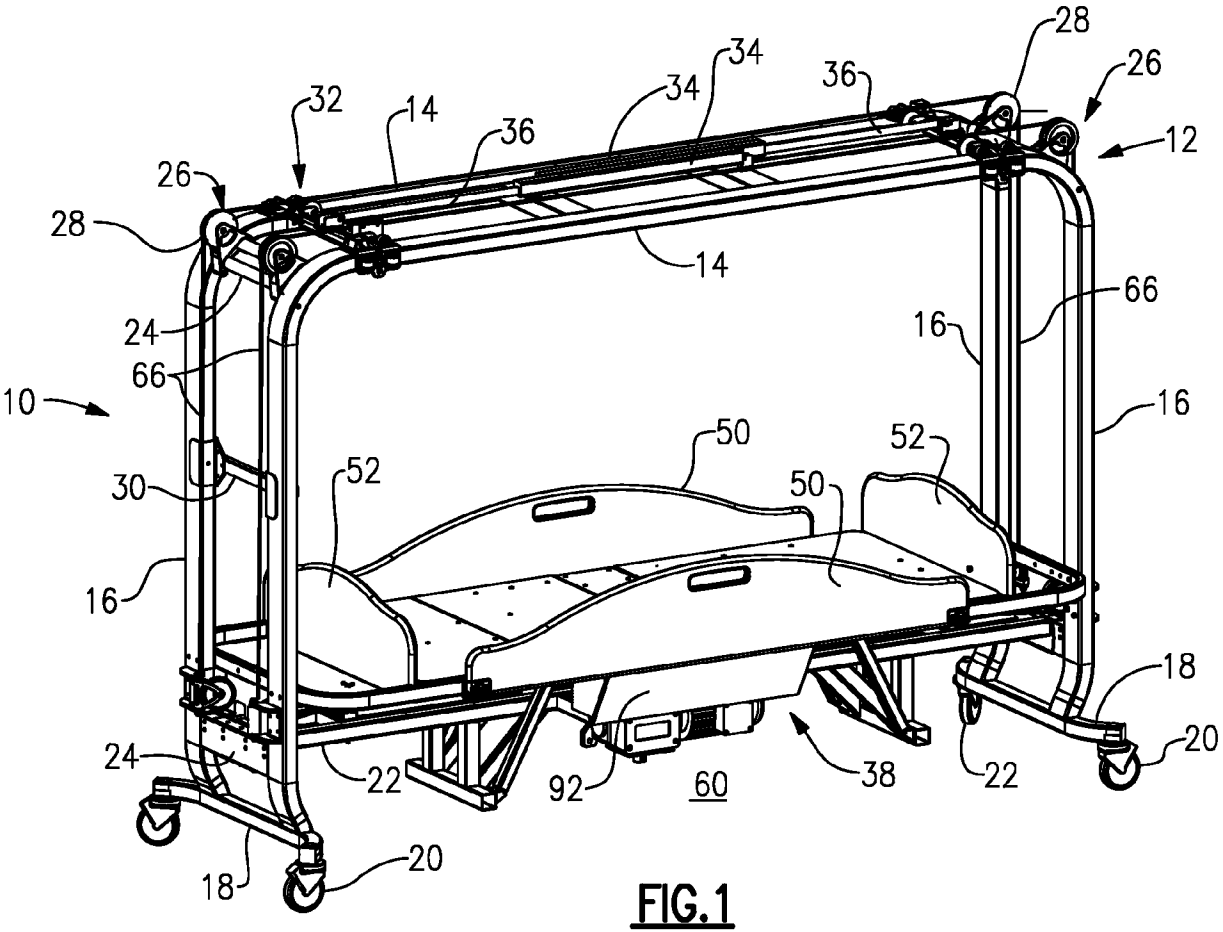
FIG. 1 is a perspective view of a passive exercise therapy apparatus, according to a first embodiment of this invention.
Figure 2:
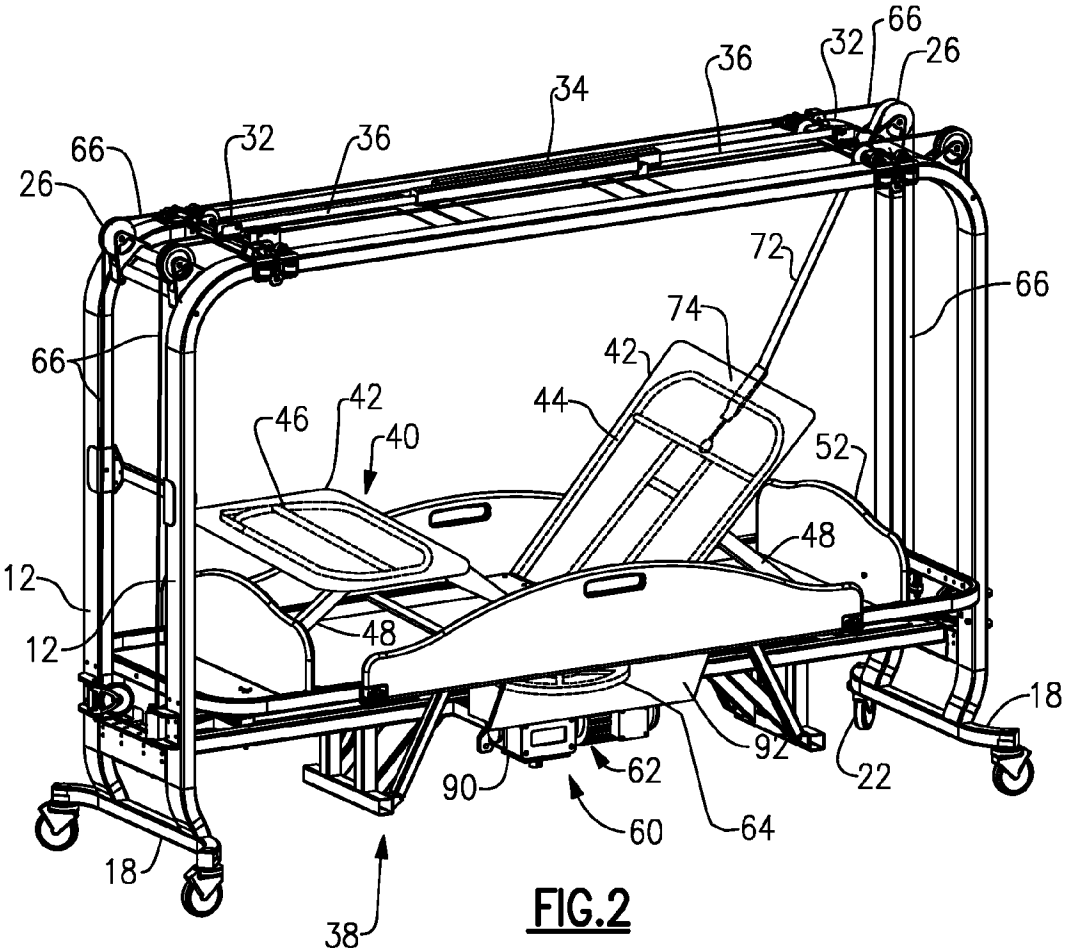
FIG. 2 is a perspective showing details thereof.

With reference to the Drawing, and initially to FIGS. 1 to 5 thereof, a passive exercise station according to one embodiment of the invention has a frame 10 in the form of a pair of generally rectangular arches 12. The exercise station is provided with guide pulleys to establish a cable run or cable runs that extend above the patient bed, and with a gear motor and cable drive wheel on the bed frame beneath the patient. These elements and features will be described shortly. The arches 12 are disposed parallel to one another, and each is formed of a series of rails. Each arch has a horizontal upper rail 14, so there is one rail 14 on the forward side arch and one rail 14 on the rearward side arch, and a pair of vertical rails or risers 16, 16, so for each arch there is a riser 16 on the left and one on the right. Here right and left ends of each arch 12 correspond to the foot and head of the patient, respectively, while the rearward side of the frame 10 corresponds to the patient's right side where the patient is lying supine, and accordingly the forward side corresponds to the patient's left side. There are also a pair of base rails 18 or footings, with one base rail joining the bottom ends of the left risers 16 of the two arches 12 and the other base rail 18 joining the bottom ends of the right risers 16 of the two arches. Wheels or casters 20 are mounted at the ends of these base rails. The wheels or casters 20 allow the apparatus to be rolled into place, i.e., within a room, or to be transported easily from one room to another. There are two lower support rails 22, 22 located beneath the patient position on the frame 10 and extending longitudinally from the one riser 16 to the other of the respective arches 12. There are several transverse braces 24 that hold the two arches in position relative to one another. Here, there are braces 24 extending across the upper part of the frame 10 between the two upper rails 14, and there may also be one or more braces 24 between the two risers 16 at each end of the frame. A fixed cable rail 26 is situated at each of the upper corners of the frame, as illustrated, with each cable rail having one or more cable guide wheels or rollers 28, and an additional cable guide rail 30 may be positioned beneath that location on the pair or risers 16.

In this embodiment there are two adjustable carriage assemblies 32, which are described in greater detail later with reference to FIG. 5, and each of these is provided with a cable guide roller and means to permit the respective carriage assembly to slide along the two upper rails 14. A pair of linear actuators 34 have one end affixed to an anchor point on the frame 10 and a rod 36 that attaches to a respective one of the two carriage assemblies 32. The actuators are controllably actuated by a therapy technician, using a control box (not shown) to position one or both of the overhead carriage assemblies at an optimal position for the exercise therapy of a given patient.

A patient bed or platform 38 is supported horizontally on the frame 10 above the two lower support rails 22. The bed 38 supports the patient, lying in a supine (face-up) position. In this embodiment, the patient bed 38 has a multiple part tubular bed frame 40, with its various portions each supporting a lightweight plastic or metal panel 42. Here the bed frame 40 includes a head-end portion 44 and a foot-end portion 46, each of which is hinged so that it can be lifted or tilted. A linear actuator 48 is provided at each of the head end and foot end, as illustrated, so that the therapy technician can raise or lower the end portions 44, 46 as necessary for the patient's prescribed exercise. This bed arrangement permits adjustment for placing the patient in an optimal posture for passive exercise therapy. The mattress or patient support pad is omitted from the drawing.

Figure 3A:
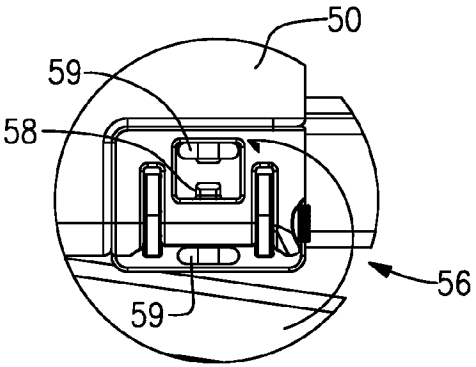
FIGS. 3A and 3B are detail views of locking hinges for side rails thereof.
Figure 3B:
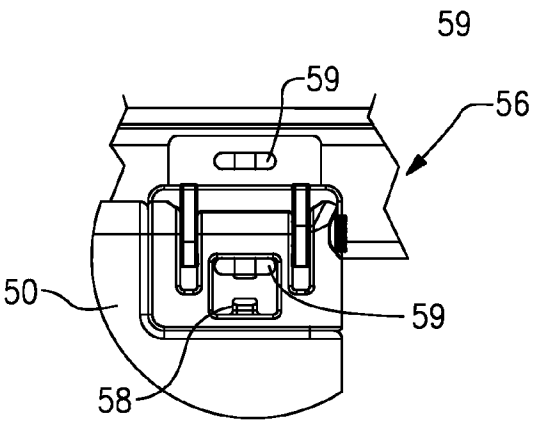
Figure 3:
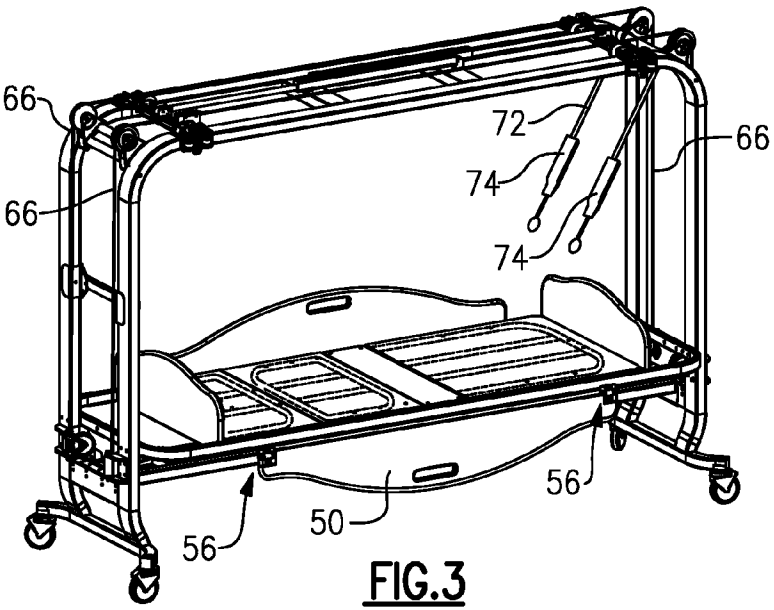
FIG. 3 is a partial perspective showing details of the patient bed portion thereof.

The patient bed 38 has side panels or side rails 50 at the patient's right and left sides, and end panels 52, i.e., a head rail and a foot rail, respectively, at the head and foot ends of the bed 38, as illustrated, e.g., in FIG. 3. As shown in FIGS. 3A and 3B, the side rails 50 are supported on the bed frame 40 with lockable hinge assemblies 56. The hinge assemblies each include a pair of tongues 58 that seat into an aperture or slot formed by a loop member 59. The side rail 50 can be raised or lowered by first moving the side rail upwards to pull the tongue 58 out of the slot, and then moving it to the upward or downward position. When the side rail 50 is in the desired position gravity holds the tongue 58 in place in the slot within the upper or lower loop member 59, so the panel or side rail 50 remains locked in that position. This arrangement is optimal for patient safety, but also allows for quick release so the patient can easily leave the patient bed when the exercise therapy session is ended.

Figure 4:
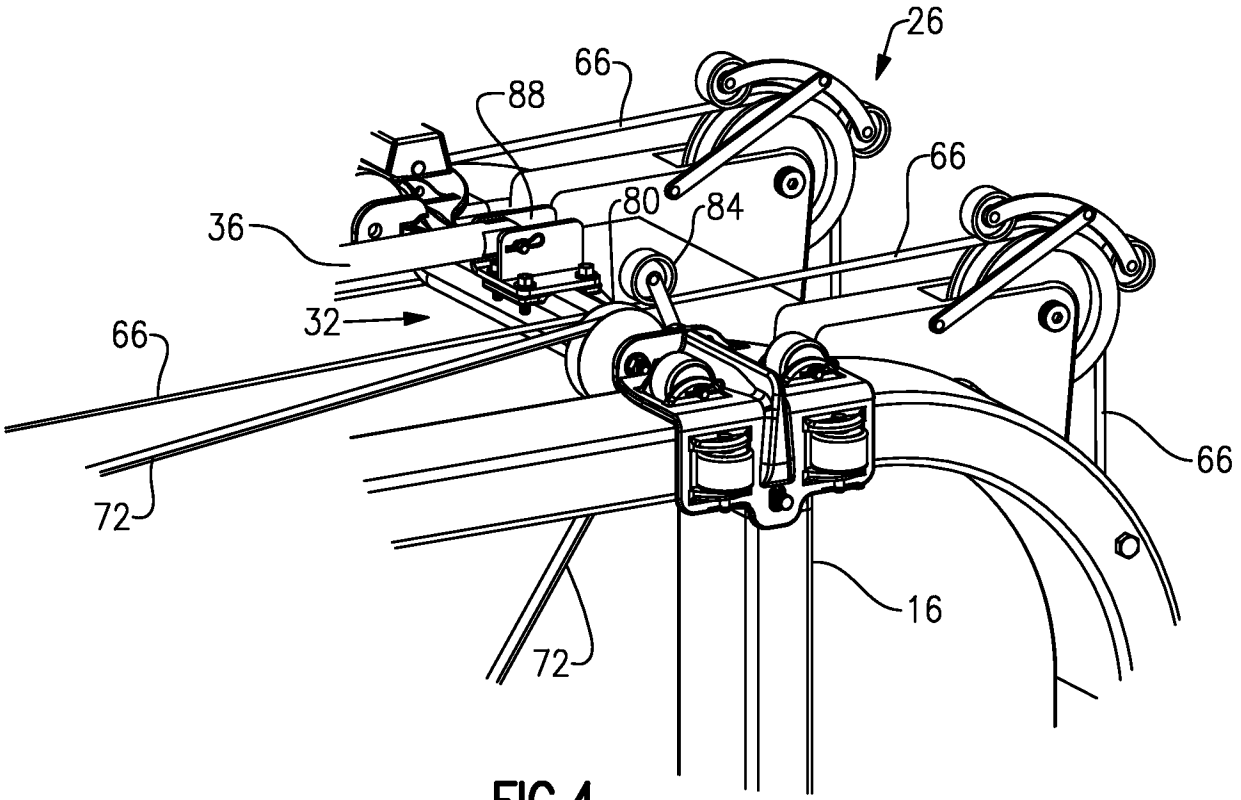
FIG. 4 is a detail view illustrating cable guide rollers employed in this embodiment.

A cable drive system 60 is mounted on the frame 10, and in this embodiment the drive system 60 is mounted on the two transverse support rails 22 beneath the patient bed 38. The system comprises an electric gear motor 62 and a wheel 64, with guard plates positioned around the wheel 64. One or more drive cables 66 can be reeved onto the guide wheel and is carried in a respective peripheral groove on the wheel. The wheel provides an oscillatory motion to the cable so that the cable 66 travels back and forth. The speed of oscillation and the amplitude of cable travel can be controlled by means of a technician control box (not shown here). The cable 66 travels over the guide wheels of the cable guides 26 in a cable path that extends over the frame 10 and across the top of the frame between the two top rails 14. The cable guide wheels can be configured as shown in FIG. 4. In this preferred embodiment, a flat flexible web 72 is spliced to the drive cable, and the web 72 extends over the adjustable carriage 32 and down to terminate at a cuff or sleeve 74 that attaches onto the patient's arm or leg. These may also be connected with patient harnesses or braces that are fitted to the patient body part to be moved. Tensioning arms and tensioning wheels are associated with the cable guide wheels, as discussed in more detail in respect to the similar structure on the adjustable carriage 32.

Figure 5:
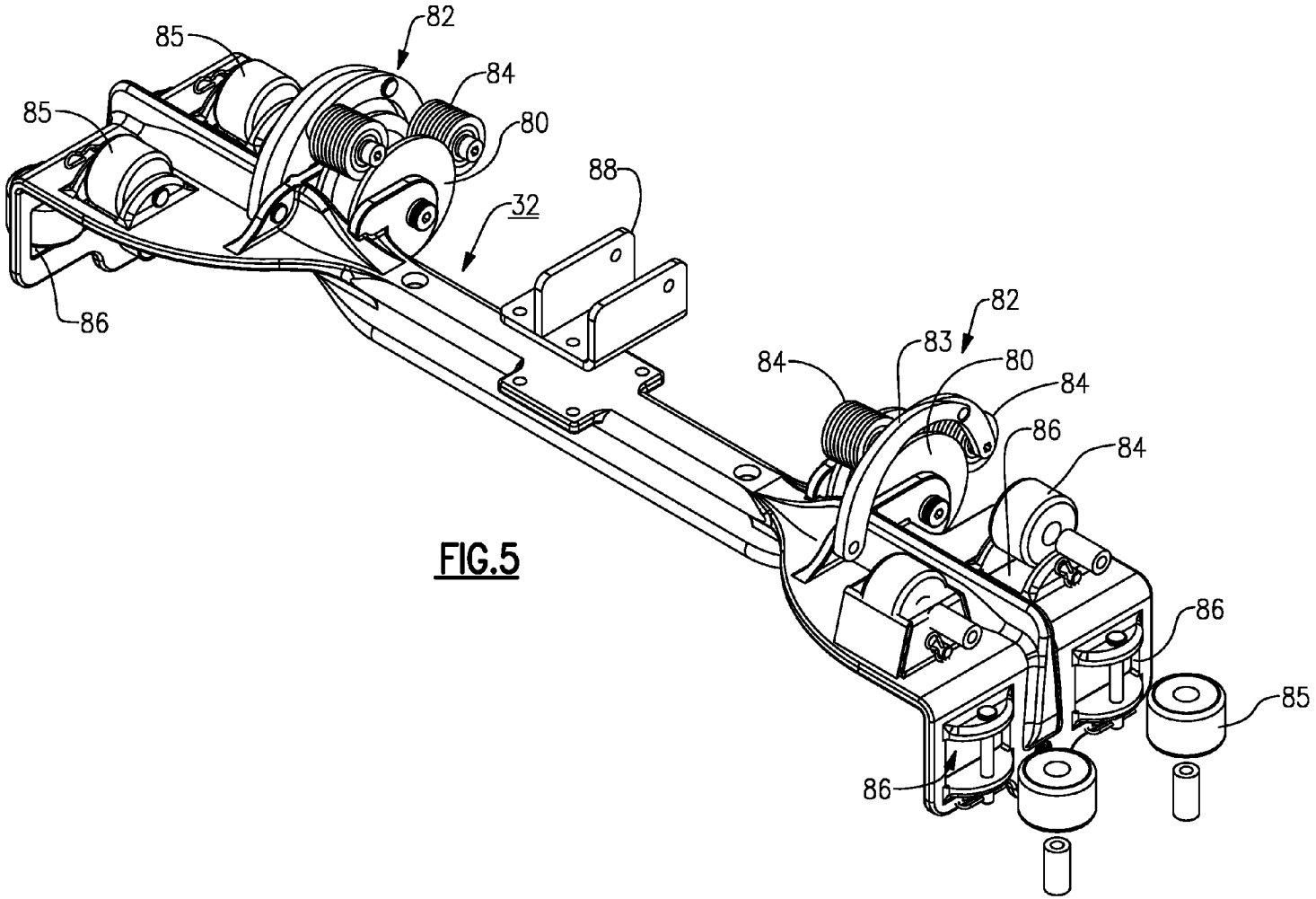
FIG. 5 is an assembly view of an adjustable guide carriage of this embodiment.

The slidable carriage 32, as shown in FIG. 5, has left and right guide rollers or guide wheels 80, and each has an associated cable tensioner 82 that bears onto the guide roller 80 and the cable or web that passes over the guide roller. The cable tensioner 82 is formed of a tension arm 83, which may be spring-loaded, to hold cable tensioning rollers 84 against the web and guide roller 80.

Carriage rollers 85 are positioned at each end of the carriage, and these contact against top edge and outer edge of the associated top rails 14. These are mounted on the carriage and contact against the top rail 14 through roller openings 86 on the top and side of the carriage end. At the mid portion of the carriage is a connector channel member 88, to which the rod 36 of the associated actuator 34 is attached.

Figure 7:
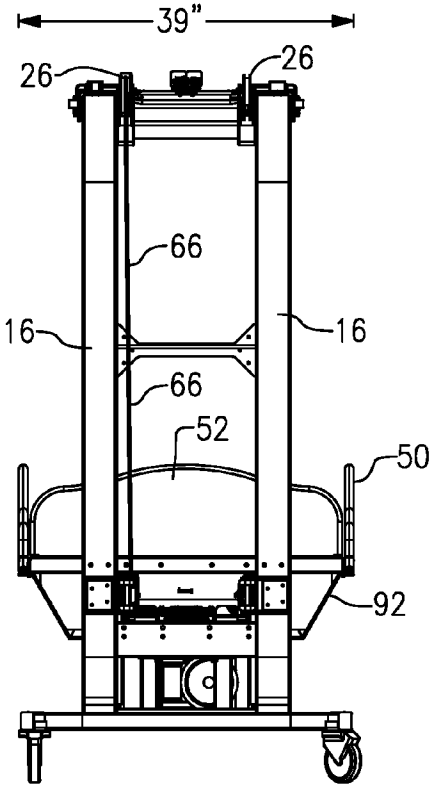
FIGS. 6 and 7 are side and end elevations thereof.
Figure 6:
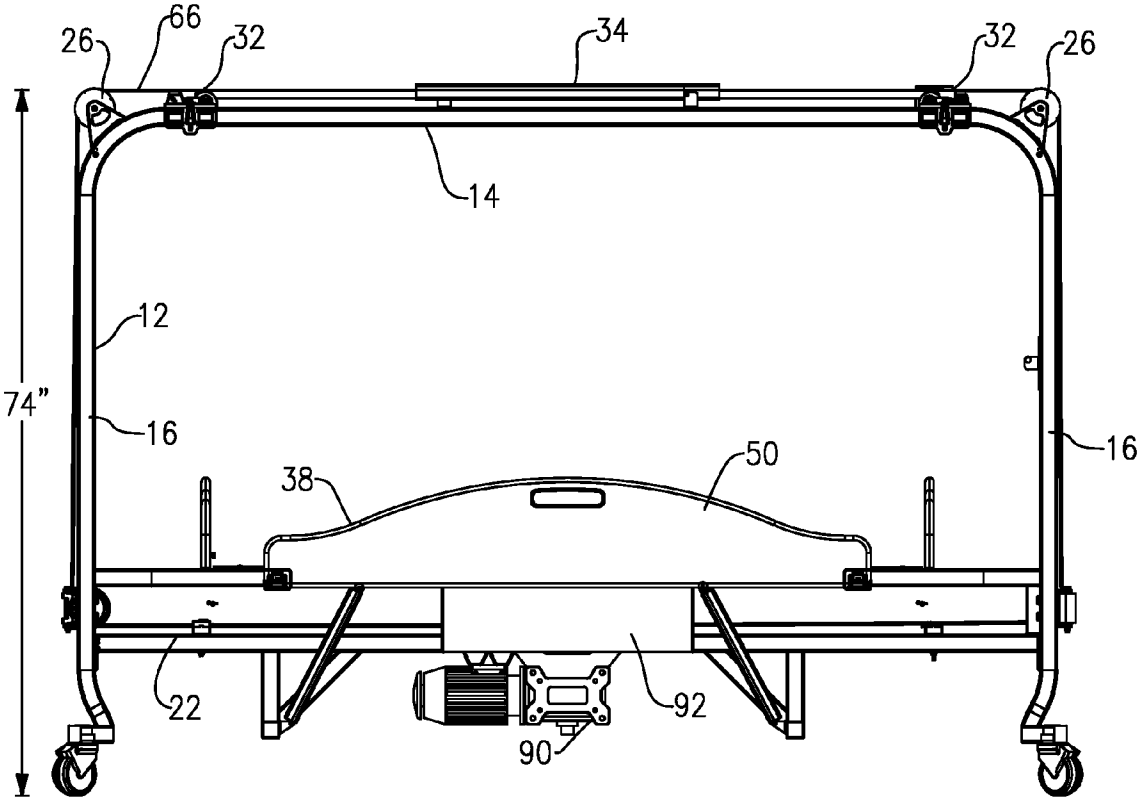

The dimensions of the exercise therapy apparatus can be explained with reference to FIGS. 6 and 7. The frame 10 has a width dimension of about 39 inches or less, and a height of about 74 inches to 80 inches, so that the frame 10 with rollers 80 will fit through any standard doorway. Also, as shown here, the gearmotor 62 and wheel 64 are shown mounted on the lower support rails 22 beneath the patient bed. Here a gearbox 90 is shown coupling the gear motor 62 to the drive wheel 64, and a protective shield or shroud 92 protects the therapist and patient from contact with the wheel or any moving parts of the motor or wheel.

Figure 8:
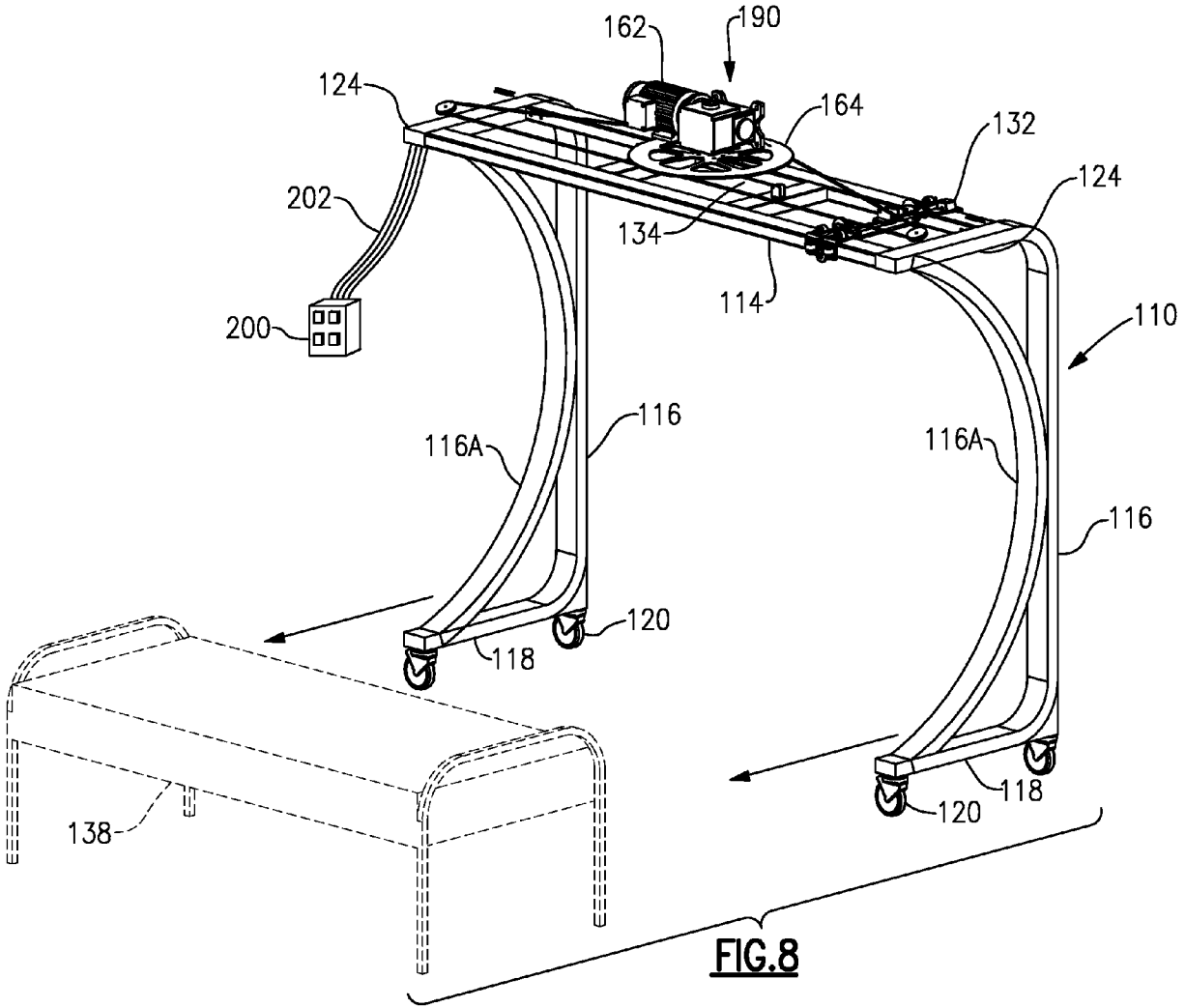
FIG. 8 is a perspective view of a second embodiment of the invention.

In a second embodiment, as shown in FIG. 8, the frame is separate from the patient bed so that the apparatus can be wheeled into place over an existing patient bed. In this second embodiment, the cable drive mechanism, including the gear motor and drive wheel, is located at the top of the frame above the patient. The frame is open at the side to permit moving it over the patient bed, and later moving the apparatus away. The frame 110 has interior dimensions of about 91 inches by 36 inches, so as to accommodate a standard bed. Here elements that correspond to similar elements in the first embodiment are identified with similar reference numbers, but raised by 100. Here, the frame 110 of open design permits it to be moved over an existing patient bed 138 (shown here in broken line). The frame is formed of a pair of upper horizontal rails 114 supported at each end by a rear upright 116 and a front upright 116A. The front upright 116A is curved back to provide better patient access. That is, the frame 110 has end arches, each formed of a generally circular arcuate member in front and a rectangular arch joined to it behind, so that the frame is open at the front, as shown. At the lower end of the front and rear uprights are a base rail 118 (with wheels or casters 120 as shown) and at the upper end is a horizontal brace 124 joining the upper ends.

In this embodiment, the drive mechanism is mounted at an overhead position on the top or overhead rails 114. This view shows the position of the gearmotor 162 and cable drive wheel 164, together with associated gear box 190. The cable or cables pass from the drive wheel 164 over guide pulleys on a movable carriage assembly 132. A linear actuator 134 adjusts the position of the carriage, similar to the arrangement of the first embodiment.

The passive exercise arrangement of this embodiment can be wheeled or rolled into place over the patient without the patient having to be moved from another place into the apparatus. The cables (or webs) pass over the carriage 132 and then extend down to the location of the patient. The cable(s) or web(s) are attached onto the patient's arm or leg in a fashion similar to that of the first embodiment, and can move the patient's limb for a prescribed number of repetitions of an exercise motion. As seen in this view, a technician electrical control module or control box 200 is suspended from the frame 110 on a flexible electrical control cable 202 or arm to permit adjustment of the carriage position, and to adjust the speed and amplitude of the cable oscillations, and to control the number or repetitions and/or duration of the passive exercise session.

The electrical power cord(s) associated with these two embodiments are not shown in these drawings.

In the illustrated embodiments, the gear motor and horizontal drive wheel are mounted either on the support rails beneath the patient bed or on the top rails of the frame. However, in other possible embodiments, the drive mechanism can be located on another part of the frame, so long as the main cable runs over guide pulleys on the frame and over the guide pulleys on the adjustable carriage assembly.

The following benefits and features are available in the apparatus of this invention:

The system moves extremities of the patient at variable speeds and angles, and can be used to assist to elongate the spine, and for positive pressure relief of joints, with a full range of motion for all limbs.

The apparatus can be used in diverse applications, with adjustably variable speed from zero to twenty cycles per minute, and with a weight capacity up to e.g., 1000 pounds. The apparatus have a variability feature with an adjustable rail and with the capability to lock or not lock. The apparatus may employ triangular supports and bracing for movement stabilization.

The system establishes consistent repetitive motion action, with accurate alignment relative to the patient, and full adjustability of foot and head positions for patient comfort. The overhead pivot points for the exercise cables are adjustable to permit adjustment and variability of angle and distance of lift.

The drive can be mounted at the top or at the base of the frame. The side rails may be adjustable, and the bed frame may accommodate specialty mattresses—magnetic, therapeutic wave, etc.

While passive, no-resistance exercise motion has been discussed here, resistance can be added if needed for a given patient exercise therapy prescription.

Other possible features can include adjustable height for the frame, as well as limited depth, allowing it to pass through a standard door frame or a wheelchair access door frame. A fold-down TV/DVD player may be incorporated, as well as a remove video audio system. The controls for operation may be computerized so that it can be controlled either locally or at a central therapy control location at the medical center. This may be wired or wireless.

A hand-held control for the patient may be provided, including an emergency shut-off, with dual emergency shut-off switches for attendant access or override.

The apparatus may replace a hospital bed, or may supplement the hospital bed.

This exercise apparatus may be employed in nursing homes, home healthcare applications, hospitals, or veterans' centers. The exercise apparatus may be used for professional or collegiate sports therapy, or coma patients, paralyzed or partially paralyzed patients, burn victims, disabled children or adults, stroke victims, and/or joint replacement patients. Computer software and appropriate computer hardware may be incorporated with features for controlling therapy sessions and exercise movements, and for tracking patient progress.

While the invention has been described in terms of preferred embodiments, it should be appreciated that many variations thereof are possible and would present themselves to persons of skill in the art without departing from the scope and spirit of this invention.

We claim:

1. A passive exercise therapy apparatus for imparting to a patient positioned on a bed a controlled rhythmic repetitive exercise motion, to move a limb or limbs or body part of the patient through a prescribed range of motion without stress to the limbs or associated joints of the patient, the exercise therapy apparatus comprising:

a frame formed of a pair of arches that are joined in parallel to one another, the frame including a set of horizontally disposed overhead rail members, a pair of risers joined to the overhead rail members at one end thereof, a pair of risers joined to the overhead rail members at their other end, and one or more transverse brace members joining the upper rail members to one another, with the frame defining a patient bed position within the frame in which a patient may be placed for passive exercise;

a plurality of guide pulley members disposed at least at upper ends of said risers on said frame;

at least one drive cable extending over the guide pulley members on said frame and passing across said overhead rail members above the patient bed position;

a drive system positioned on the frame including a gear motor and a drive wheel, the at least one drive cable being attached to and moved by the drive wheel and the at least one drive cable following a loop around the frame through said guide pulley members and connected with the drive wheel to oscillate back and forth as said drive wheel turns;

an exercise cable attached onto said at least one drive cable and descending to said patient bed position and adapted to attach to a limb of the patient to move the patient limb through a prescribed passive exercise motion;

an adjustably positionable exercise cable carriage movably positioned on the overhead rail members of the frame and said at least one drive cable passing over the adjustably positionable exercise cable carriage as said at least one drive cable follows its loop around the frame, and said adjustably positionable exercise cable carriage carrying at least one guide pulley;

said exercise cable passing around said at least one guide pulley of said carriage and descending to said patient bed position; and wherein the drive wheel, the at least one drive cable and the exercise cable being configured so that as the gear motor rotates the drive wheel, the drive wheel imparts a continuous back-and- forth rhythmic motion onto the at least one drive cable traveling over said guide pulley members, with a controlled, rhythmic, repetitive relative motion of the drive cable in respect to the bed so that the exercise cable that is attached to it moves the patient limb through the prescribed range of motion in a controlled rhythmic repetitive fashion.

2. The passive exercise therapy apparatus of claim 1 comprising at least a pair of lower support rails extend horizontally below said patient bed position and wherein a patient bed frame is supported on said lower rails; and wherein said drive system is mounted on said lower rails beneath said bed frame.

3. The passive exercise therapy apparatus of claim 1 wherein said drive wheel is oriented horizontally.

4. The passive exercise therapy apparatus of claim 1 wherein a pair of transverse base rails respectively join lower ends of said pairs of risers, and comprising a set of casters mounted on said transverse base rails.

5. The passive exercise therapy apparatus of claim 4 wherein said frame has a height dimension not exceeding 84 inches and a width dimension not exceeding 39 inches.

6. The passive exercise therapy apparatus of claim 1 wherein said adjustably positionable exercise cable carriage includes at least one transversely disposed cable carriage having a pair of guide pulleys adapted to receive said exercise cable, and a set of carriage rollers disposed at each end of said cable carriage to contact the overhead rail members, respectively, and permit the cable carriage to be moved horizontally along said overhead rail members.

7. The passive exercise therapy apparatus of claim 6 comprising one or more linear actuators mounted on said frame between said overhead rail members, and having a rod portion attached onto the associated cable carriage for positioning said cable carriage at a selected location over said patient bed position.

8. The passive exercise therapy apparatus of claim 6 said cable carriage further including for each said guide pulley on said carriage an associated spring-loaded cable tensioner holding the exercise cable against the respective guide pulley.

9. The passive exercise therapy apparatus of claim 1 comprising at least a pair of lower support rails extending horizontally below said patient bed position and wherein a patient bed frame is supported on said lower rails; said patient bed frame including at least one side rail including locking hinges connecting the side rail to the patient bed frame to permit the side rail to be placed in an upward position and in a downward position, each said locking hinge including a hinge member and one or more tongue member that releasably engage a slot defined on said hinge member.

10. The passive exercise therapy apparatus of claim 9 wherein head and foot portions of said bed frame are hinged to permit the head and foot portions to be elevated to a desired patient position.

11. The passive exercise therapy apparatus of claim 10 comprising one or more linear actuators mounted on said frame and having a rod portion connected with an associated one of said head portion and said foot portion for urging the respective portion to a desired patient position.

12. The passive exercise therapy apparatus of claim 9 comprising a support panel of a plastic material supported on each of the head portion and foot portion of said bed frame.

13. The passive exercise therapy apparatus of claim 9 comprising a support panel of a metal material supported on each of the head portion and foot portion of said bed frame.

14. The passive exercise therapy apparatus of claim 1 said drive system including a protective shroud positioned over said drive wheel.

15. The passive exercise therapy apparatus of claim 1 wherein said controlled, rhythmic, repetitive relative motion of the exercise cable and the patient limb is carried out automatically by action of the gear motor and said drive wheel.

16. The passive exercise therapy apparatus of claim 1 wherein said at least one drive cable includes first and second drive cables that reciprocate by action of said drive wheel to effect repeated rhythmic movement of the patient limb over a prescribed range of motion.

17. The passive exercise therapy apparatus of claim 1 wherein the drive system provides a speed of oscillation and amplitude of travel of said at least one drive cable that is controllable over a range.

18. The passive exercise therapy apparatus of claim 17 wherein the speed of oscillation of said drive cable is adjustable up to 20 cycles a minute.

19. A passive exercise therapy apparatus for imparting to a patient positioned on a bed a controlled rhythmic repetitive exercise motion, to move a limb or limbs or body part of the patient through a prescribed range of motion without stress to the limbs or associated joints of the patient, the exercise therapy apparatus comprising:

a frame formed of a pair of arches that are joined in parallel to one another, the frame including a set of horizontally disposed overhead rail members, one pair of risers joined to the overhead rail members at one end thereof, another pair of risers joined to the overhead rail members at their other end, and one or more transverse brace members joining the upper rail members to one another, with the frame defining a patient bed position within the frame such that the frame may be placed over a patient bed for carrying out passive exercise;

a plurality of guide pulley members disposed on said frame at upper ends of said risers;

at least one drive cable extending over said guide pulley members on the overhead rail members of said frame and passing across said overhead rail members above the patient bed position;

a drive system positioned on the frame wherein said drive system is mounted on said overhead rail members above said patient position, including a gear motor and a drive wheel, the at least one drive cable being attached to and moved by the drive wheel and the drive cable following a loop around the overhead rail members through said guide pulley members and being connected with the drive wheel;

an exercise cable attached onto said at least one drive cable and descending to said patient bed position and adapted to attach to a limb of the patient to move the patient limb through a prescribed passive exercise motion;

an adjustably positionable exercise cable carriage movably positioned on the overhead rail members of the frame and said at least one drive cable passing over the adjustably positionable exercise cable carriage as said at least one drive cable follows its loop around the overhead rail members, and said adjustably positionable exercise cable carriage carrying at least one guide pulley;

said exercise cable passing around said at least one guide pulley of said carriage and descending to said patient bed position; and wherein the drive wheel, the at least one drive cable and the exercise cable being configured so that as the gear motor rotates the drive wheel, the drive wheel imparts a continuous back-and- forth rhythmic motion onto the at least one drive cable traveling over said guide pulley members, with a controlled, rhythmic, repetitive relative motion of the drive cable in respect to the bed so that the exercise cable that is attached to it moves the patient limb through the prescribed range of motion in a controlled rhythmic repetitive fashion.

20. The passive exercise therapy apparatus of claim 19, wherein said frame has an inside zone defined between said risers that is open and has dimensions of not less than 36 inches by not less than 91 inches so as to permit placing the apparatus over an existing standard hospital bed.

* * * * *